US005380969A

United States Patent [19]

Yang

[11] Patent Number: 5,380,969

[45] Date of Patent: Jan. 10, 1995

[54] COMPUTER KEY

[75] Inventor: Yung-Chyuan Yang, Taipei, Taiwan, Prov. of China

[73] Assignee: Sen-Cheng Wang, Taiwan, Prov. of China

[21] Appl. No.: 53,398

[22] Filed: Apr. 28, 1993

[51] Int. Cl.[6] ..... H01H 1/10

[52] U.S. Cl. ..... 200/517; 200/341; 200/344; 200/345; 200/290; 200/5 A

[58] Field of Search ..... 200/5 A, 341, 345, 344, 200/517, 520, 515, 512, 290, 342

[56] References Cited

U.S. PATENT DOCUMENTS

| | | | |
|---|---|---|---|
| Re. 30,435 | 11/1980 | Fukao | 200/345 |
| 3,582,594 | 6/1971 | Twytonu | 200/341 |
| 3,668,356 | 6/1972 | Kekas | 200/345 X |
| 4,631,378 | 12/1986 | Nobesawa | 200/342 |
| 4,720,609 | 1/1988 | Hochgesang et al. | 200/5 A |
| 4,952,762 | 8/1990 | Koyanagi | 200/517 |
| 5,203,448 | 4/1993 | Osada et al. | 200/517 |

FOREIGN PATENT DOCUMENTS

| | | | |
|---|---|---|---|
| 3112328 | 10/1992 | Germany | 200/341 |
| 57114 | 3/1991 | Japan | 200/341 |
| 4073829 | 3/1992 | Japan | 200/517 |

*Primary Examiner*—Ernest G. Cusick

*Attorney, Agent, or Firm*—Banner, Birch, McKie and Beckett

[57] ABSTRACT

A computer key includes a socket member which confines a receiving space therein and which has a top wall that is provided with a through hole, a resilient biasing member which is disposed inside the receiving space of the socket member, and a support member which has an upright tubular portion and a flange portion that projects radially outward from an intermediate part of the tubular portion and that is in sliding contact with an inner wall surface of the socket member. The support member is provided inside the receiving space of the socket member such that the tubular portion extends through the through hole of the socket member. The tubular portion has a bottom end which rests on top of the biasing member. The biasing member urges the support member upward to a normal unpressed key condition. A push button is secured on top of the support member. The flange portion is provided with at least one spring unit to cushion impact between the flange portion and the top wall of the socket member when the biasing member expands to return the support member to the normal unpressed key condition due to the removal of an applied force on the push button.

3 Claims, 2 Drawing Sheets

COMPUTER KEY

BACKGROUND OF THE INVENTION

1. Field of the Invention

The invention relates to a computer key construction, more particularly to a computer key which moves smoothly and which generates less noise when operated.

2. Description of the Related Art

Referring to FIG. 1, a conventional computer key is shown to comprise a push button (A), a support member (B), an upright socket member (C) and a resilient biasing member (D). The push button (A) has a slightly concave top portion (A1) with a downwardly extending peripheral flange (A2). A mounting projection (A3) extends downward from the rear side of the top portion (A1). The support member (B) includes an upright tubular portion (B1) and a rectangular flange portion (B3) which projects radially outward from an intermediate part of the tubular portion (B1). The socket member (C) confines a receiving space (C2) therein and has a top wall which is provided with a through hole (C1). Referring to FIG. 2, the support member (B) is provided inside the receiving space (C2) of the socket member (C) such that the tubular portion (B1) of the former extends through the through hole (C1) of the latter. The mounting projection (A3) of the push button (A) is mounted fittingly on the tubular portion (B1) of the support member (B), thereby securing the push button (A) on the support member (B). The flange portion (B3) is in sliding contact with the inner wall surface of the socket member (C). Four legs (B2) extend downwardly from four corners of the flange portion (B3) so as to restrict downward movement of the support member (B) in the socket member (C).

The resilient biasing member (D) has a convex support portion (D1) which is disposed inside the receiving space (C2) of the socket member (C). The bottom end of the tubular portion (B1) rests on a top end of the support portion (D1). A conductive member (not shown) is secured on a rear side of the top end of the support portion (D1). The biasing member (D) urges the support member (B) upward so that the flange portion (B3) abuts normally against the top wall of the socket member (C). The resilient biasing member (D) is provided on top of a circuit board (not shown). The conductive member on the biasing member (D) is spaced normally from a conductive strip on the circuit board.

When the push button (A) is pressed, the support member (B) moves downward to compress the biasing member (D), thus achieving contact between the conductive member on the biasing member (D) and the conductive strip on the circuit board to signal a pressed key condition. When the applied force is released, the biasing member (D) expands to once more urge the support member (B) to the normal unpressed key condition, thereby breaking the electrical connection between the conductive member on the biasing member (D) and the conductive strip on the circuit board.

From the foregoing, it has been shown that the biasing member (D) provides the necessary force to return the support member (B) from the pressed key position to the initial unpressed key position. However, note that as the biasing member (D) urges the support member (B) upward, the flange portion (B3) of the latter impacts the top wall of the socket member (C), thereby generating a relatively loud noise which can affect the quality of the working environment.

Referring to FIG. 3, the four sides of the flange portion (B3) are in sliding contact with the inner wall surface of the socket member (C), thus permitting stable movement of the support member (B) relative to the socket member (C). However, because of the relatively large contact area between the flange portion (B3) and the socket member (C), a relatively large friction force is thus present. Therefore, smooth movement of the support member (B) is unattainable.

SUMMARY OF THE INVENTION

The main objective of the present invention is to provide an improved computer key construction which generates less noise when operated.

Another objective of the present invention is to provide an improved computer key construction which has a smooth movement due to the presence of less friction force.

Accordingly, the preferred embodiment of a computer key of the present invention comprises:

a socket member confining a receiving space therein and having a top wall which is provided with a through hole;

a resilient biasing member disposed inside the receiving space of the socket member;

a support member including an upright tubular portion and a flange portion which projects radially outward from an intermediate part of the tubular portion and which is in sliding contact with an inner wall surface of the socket member, said support member being provided inside the receiving space of the socket member such that the tubular portion extends through the through hole of the socket member, said tubular portion having a bottom end resting on top of the biasing member, said biasing member urging the support member upward to a normal unpressed key condition, said flange portion being provided with at least one spring unit to cushion impact between the flange portion and the top wall of the socket member when the biasing member expands to return the support member to the normal unpressed key condition due to removal of an applied force on the push button; and a push button secured on top of the support member.

The spring unit comprises a resilient leaf formed by providing a substantially L-shaped slit in a periphery of the flange portion. The resilient leaf has a top surface which is formed with a stud.

The flange portion is rectangular and has four sides which form a clearance with the inner wall surface of the socket member. The flange portion further has four legs that extend downwardly and that project radially outward from four corners of the flange portion. Each of the legs has a flat outermost face with two vertically extending edges. The flange portion is in sliding contact with the inner wall surface of the socket member only at the edges of the outermost face of the legs.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 4:
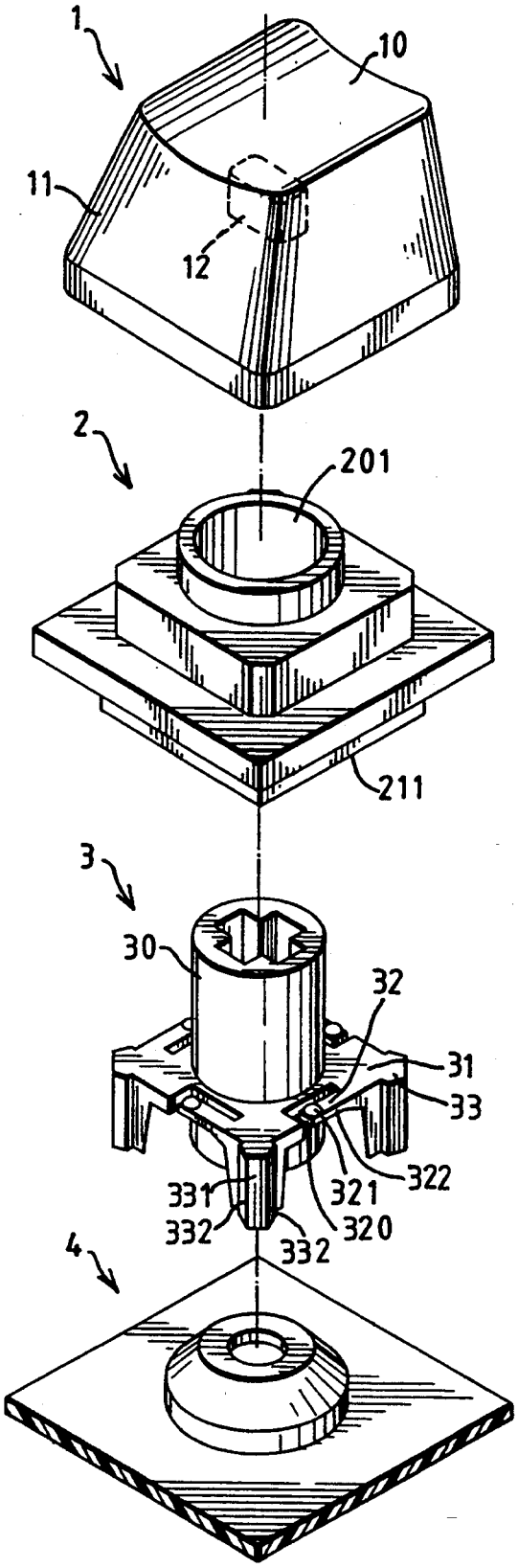
FIG. 4 is an exploded view of the preferred embodiment of a computer key according to the present invention.
Figure 5:
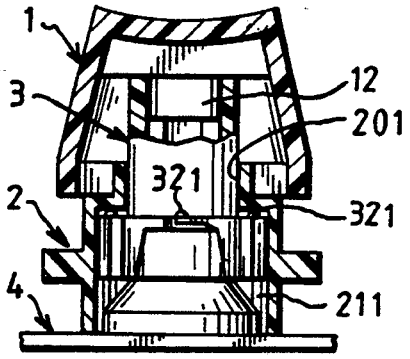
FIG. 5 is a vertical cross-sectional view of the preferred embodiment.

Referring to FIGS. 4 and 5, the preferred embodiment of a computer key according to the present invention is shown to comprise a push button (1), a support member (3), an upright socket member (2) and a resilient biasing member (4).

Figure 1:
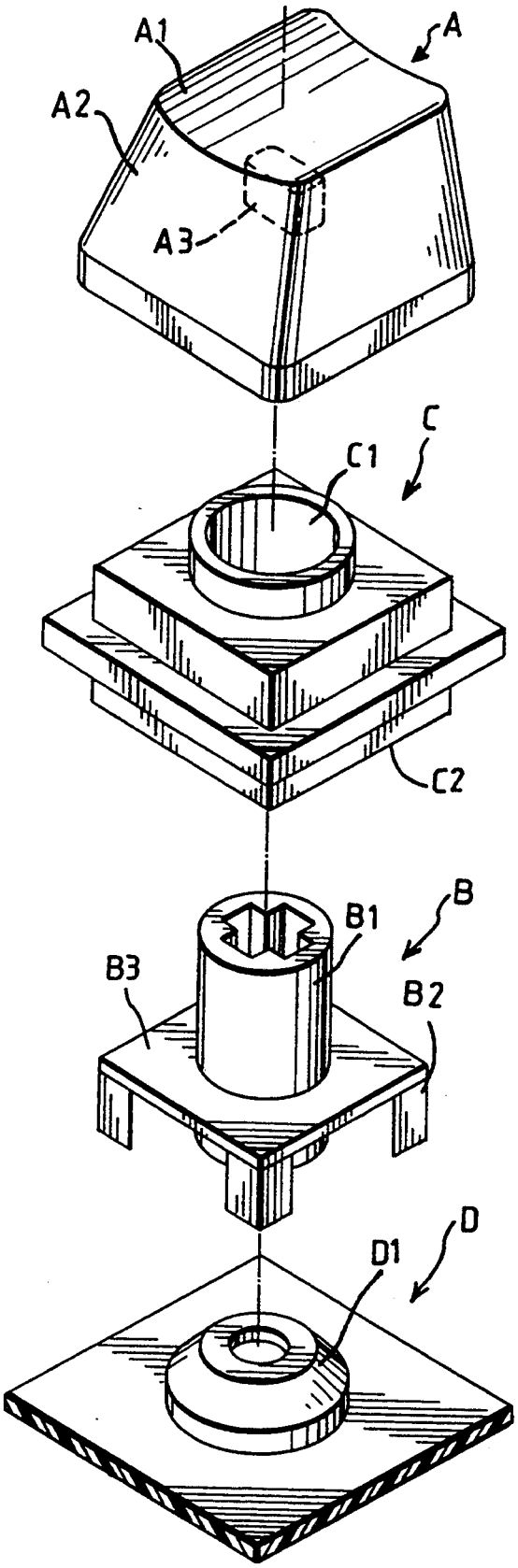
FIG. 1 PRIOR ART
FIG. 1 is an exploded view of a conventional computer key.
Figure 2:
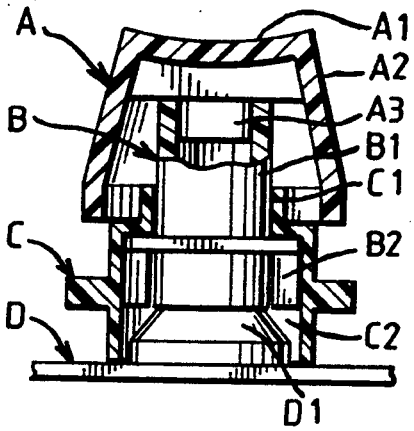
FIG. 2 PRIOR ART
FIG. 2 is a vertical cross-sectional view of the conventional computer key shown in FIG. 1.
Figure 3:
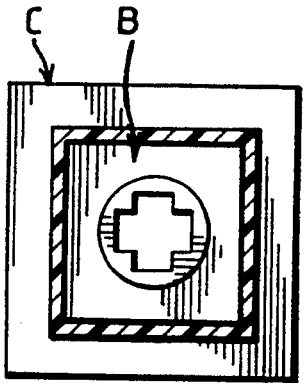
FIG. 3 PRIOR ART
FIG. 3 is a horizontal cross-sectional view of the conventional computer key shown in FIG. 1.

The push button (1) is similar to that of the conventional computer key shown in FIG. 1 and has a slightly concave top portion (10) with a downwardly extending peripheral flange (11). A mounting projection (12) extends downward from the rear side of the top portion (10).

The socket member (2) confines a receiving space (211) therein and has a top wall which is provided with a through hole (201).

The support member (3) includes an upright tubular portion (31) and a rectangular flange portion which projects radially outward from an intermediate part of the tubular portion (31). The support member (3) is provided inside the receiving space (211) of the socket member (2) such that the tubular portion (30) of the former extends through the through hole (201) of the latter. Each side of the flange portion (31) is provided with a spring unit (32). In this embodiment, the spring units (32) comprise a resilient leaf (322) formed by providing a substantially L-shaped slit (320) in each peripheral side of the flange portion (31). The resilient leaf (322) has a top surface which is formed with a stud (321). The mounting projection (12) of the push button (1) is mounted fittingly on the tubular portion (30) of the support member (3), thereby securing the push button (1) on top of the support member (3).

Figure 7:
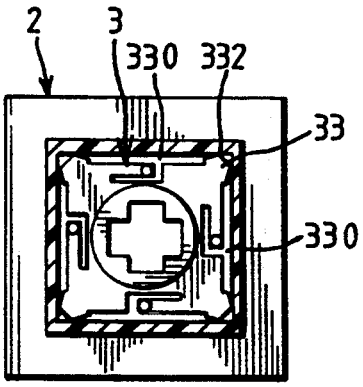
FIG. 7 is a horizontal cross-sectional view of the preferred embodiment.

Referring to FIG. 7, each side of the flange portion (31) forms a clearance (330) with the inner wall surface of the socket member (2). The flange portion (31) further has four legs (33) that extend downwardly and that project radially outward from four corners of the flange portion (31) so as to restrict downward movement of the support member (3) in the socket member (2). Each of the legs (33) has a flat outermost face (331) with two vertically extending edges (332). In this embodiment, the legs (33) are trapezoidal in cross-section. When the support member (3) is provided inside the socket member (2), only the edges (332) of the outermost face (331) of the legs (33) are in sliding contact with the inner wall surface of the socket member (2). Because of the small contact area between the flange portion (31) and the socket member (2), only a small amount of friction force is present, thereby permitting smooth movement of the support member (3). Furthermore, since contact between the flange portion (31) and the socket member (2) is distributed evenly around the periphery of flange portion (31), stable movement of the support member (3) relative to the socket member (2) can be maintained.

The resilient biasing member (4) is similar to that of the conventional computer key shown in FIG. 1 and is disposed inside the receiving space (211) of the socket member (2). The bottom end of the tubular portion (30) rests on top of the biasing member (4). The biasing member (4) urges the support member (3) upward so that the studs (321) abut normally against the top wall of the socket member (2).

Figure 6:
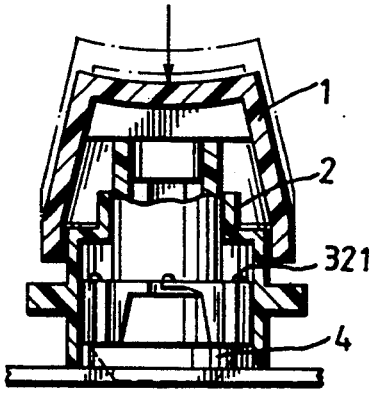
FIG. 6 illustrates the movement of the computer key of the present invention.

Referring to FIG. 6, when the push button (1) is pressed, the support member (3) moves downward to compress the biasing member (4). An electric signal is then generated in a conventional manner so as to indicate a pressed key condition. When the applied force is released, the biasing member (4) expands to once more urge the support member (3) to return to the normal unpressed key condition, thereby disrupting the generation of the electric signal. As the biasing member (4) urges the support member (3) upward, the studs (321) on the resilient leaves (322) impact the top wall of the socket member (2). Because of the resilient property of the leaves (322), the spring units (322) can cushion the impact between the support member (3) and the top wall of the socket member (3). Less noise is generated when the computer key of the present invention is in use.

It has thus been shown that the computer key of the present invention incorporates spring units (32) which serve to cushion the impact between the socket member (2) and the support member (3), thereby minimizing the generation of noise which can affect the quality of the working environment. Furthermore, the configuration of the support member (3) has been modified so as to minimize the contact area between the support member (3) and the inner wall surface of the socket member (2), thereby minimizing correspondingly the friction force that is present. A smooth and stable computer key movement can thus be attained by the computer key construction of the present invention.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A computer key including a socket member confining a receiving space therein and having a top wall which is provided with a through hole, a resilient biasing member disposed inside said receiving space of said socket member, a support member including an upright tubular portion and a flange portion which projects radially outward from an intermediate part of said tubular portion and which is in sliding contact with an inner wall surface of said socket member, said support member being provided inside said receiving space of said socket member such that said tubular portion extends through said through hole of said socket member, said tubular portion having a bottom end resting on top of said biasing member, said biasing member urging said support member upward to a normal unpressed key condition, and a push button secured on top of said support member, wherein the improvement comprises:

said flange portion being provided with at least one spring unit to cushion impact between said flange portion and said top wall of said socket member when said biasing member expands to return said support member to the normal unpressed key condition due to removal of an applied force on said push button.

2. The computer key as claimed in claim 1, wherein said spring unit comprises a resilient leaf formed by providing a substantially L-shaped slit in a periphery of said flange portion, said resilient leaf having a top surface formed with a stud.

3. The computer key as claimed in claim 1, wherein said flange portion is rectangular and has four sides which form a clearance with said inner wall surface of said socket member, said flange portion further having four legs that extend downwardly and that project radially outward from four corners of said flange portion, each of said legs having a flat outermost face with two vertically extending edges, said flange portion being in sliding contact with said inner wall surface of said socket member only at said edges of said outermost face of said legs.

* * * * *